United States Patent [19]

Bentz

[11] 4,059,424

[45] Nov. 22, 1977

[54] APPARATUS FOR THE CONTROLLED SUPPLY OF CRYOGENIC FLUID

[75] Inventor: Gerard Bentz, Elancourt-Trappes, France

[73] Assignee: L'air Liquide, Societe Anonyme pour l'etude et l'exploitation des Procedes Georges Claude, Paris, France

[21] Appl. No.: 656,968

[22] Filed: Feb. 10, 1976

[30] Foreign Application Priority Data

Feb. 25, 1975 France ..... 75.05734

[51] Int. Cl.[2] ..... F17C 7/02

[52] U.S. Cl. ..... 62/49; 62/55; 73/295; 137/392; 137/613

[58] Field of Search ..... 137/392, 613; 73/295; 62/49, 55, 129, 54

[56] References Cited

U.S. PATENT DOCUMENTS

| | | | |
|---|---|---|---|
| 2,440,738 | 5/1948 | Cooper | 62/54 X |
| 2,798,364 | 7/1957 | Morrison | 62/54 |
| 2,924,234 | 2/1960 | Wilson | 137/392 |
| 3,206,938 | 9/1965 | Damsz | 62/55 |
| 3,506,033 | 4/1970 | Haney | 137/613 X |
| 3,734,123 | 5/1973 | Pomerantz | 137/392 |
| 3,763,901 | 10/1973 | Viland | 62/54 X |

*Primary Examiner*—Ronald C. Capossela
*Attorney, Agent, or Firm*—Young & Thompson

[57] ABSTRACT

This invention relates to the distribution, in free air, of the liquid phase of a cryogenic fluid which is stored under pressure.

The apparatus consists of a phase-separator, a collecting tank for the liquid phase, an electrical system for controlling an electrical valve in order to hold the level in the tank constant, an adjusting member and distributor means.

The invention is applicable to the inertizing of metallurgical furnaces or moulds, the protection of casting jets and molten metal, to the filling of containers, etc.

14 Claims, 1 Drawing Figure

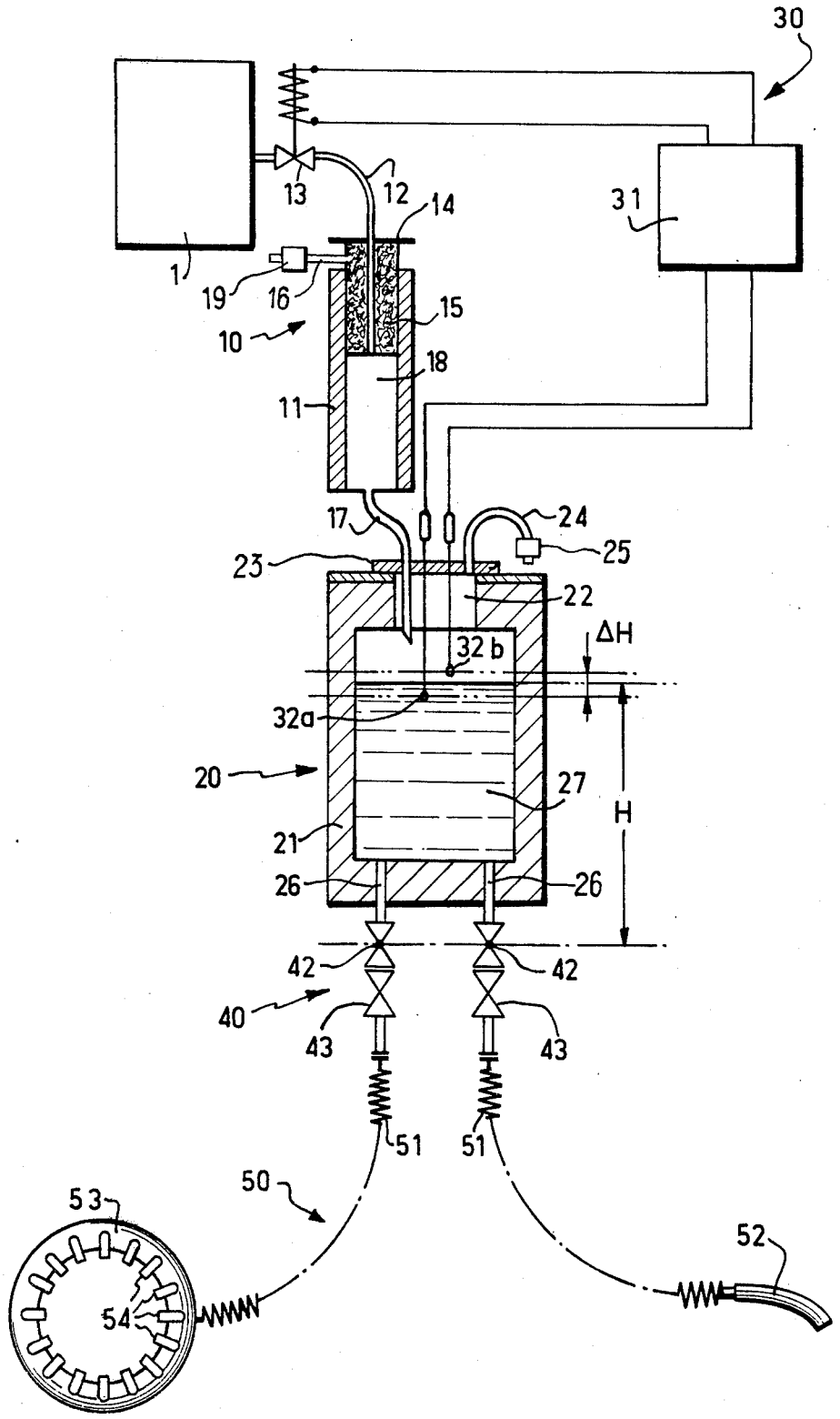
30
31
1
13
12
14
19
16
15
10
18
11
17
24
25
23
22
ΔH
32b
32a
20
27
H
21
26
26
42
42
40
43
43
51
51
50
53
52
54

APPARATUS FOR THE CONTROLLED SUPPLY OF CRYOGENIC FLUID

BACKGROUND OF THE INVENTION

The present invention relates principally to apparatus delivering the liquid phase of a cryogenic fluid, which is stored under pressure in a storage tank, to a point open to free air at which it is to be used.

Cryogenic fluids, and in particular inert gases such as argon and nitrogen, are widely used at the present time in various technical fields; for example, in metallurgy for inertizing certain installations or pieces of apparatus or to protect molten metals by means of layers of liquid; in mechanics in the production of certain hydraulic or pneumatic mechanisms; in chemistry for cooling or solidifying certain substances, and so on. In these diverse applications the fluid has to be supplied in free air, i.e., at atmospheric pressure. However, supplying it under these conditions creates considerable problems, due to the severe turbulence which exists in the liquid phase. In cases where molten metals are being protected, this turbulence prevents a homogeneous protective layer from being obtained. When a container is being filled, particularly one of small dimensions, it causes losses, and it prevents an accurately metered quantity of the cryogenic fluid from ever being transferred.

Hitherto, no satisfactory solution has been found to the problem of supplying a cryogenic fluid in quantities capable of precise measurement under conditions which allow a smooth flow.

SUMMARY OF THE INVENTION

To this end the invention proposes apparatus formed from the following elements: a phase-separator incorporating an infeed duct connected to the storage tank, to allow the said fluid, which is delivered in the form of a two-phase mixture, to pass to the said separator and discharge means to allow the liquid phase of the said mixture to flow out by gravity, the said infeed duct being provided with a valve which can be remotely actuated; a liquid-collecting container which is fed by the said discharge means and which includes outlet means to allow the body of liquid collected in the said container to flow out by gravity; a system for controlling the aforementioned valve which is sensitive to the level of liquid in the said container and which is intended to maintain this level constant; adjustable-throughput withdrawal means connected to the aforesaid outlet means from the said container; and distributor means connected to the said withdrawal means which deliver the liquid phase to the said point at which it is to be used.

De-pressurisation and de-gasification of the fluid in the separator make it possible for a turbulence-free liquid phase to be obtained in the container.

Storing the liquid phase in a reservoir in which the level is constant makes it possible for the said liquid to flow out by gravity under a pressure head which is held constant.

The use of a system for controlling the throughput of fluid arriving at the phase separator allows the pressure head to be controlled automatically.

Finally, the use of adjustable withdrawal means and of distributor means enables the fluid to be utilised at the required point under the desired conditions.

Consequently, apparatus according to the invention makes it possible to obtain homogeneous protective layers, to pour metered quantities of liquid into containers, even ones of small dimensions, and it therefore provides a satisfactory solution to the problem mentioned above.

In accordance with another feature of the invention, the aforementioned phase-separator has a heat-insulated enclosure forming an expansion chamber into which opens the said infeed duct and which has, in its upper part, a passage communicating with the atmosphere to take away the gaseous phase, said discharge means being formed by a pipe which opens from the lower part of the enclosure.

In accordance with another feature of the invention, the valve is an electrical valve.

In accordance with yet another feature of the invention, the container referred to above is formed by a tank provided with heat-insulated walls which has, in its upper part, a vent communicating with the atmosphere, said outlet means being formed by at least one opening provided in the bottom wall of the said tank.

Other features and advantages of the invention will become apparent in the course of the following description.

BRIEF DESCRIPTION OF THE DRAWING

The accompanying drawing, which is given solely as a non-limiting example, is a schematic view of a preferred embodiment of apparatus according to the invention.

DETAILED DESCRIPTION OF A PREFERRED EMBODIMENT

The depicted embodiment of apparatus according to the invention, which is intended to supply the liquid phase of a cryogenic fluid which is stored at a greater or lesser pressure in a tank 1, consists in essence of a phase-separator 10, a container 20 for collecting the liquid phase, an electrical control system 30 the function of which is to hold the liquid in container 20 at a constant level, withdrawal means 40, and distributor means 50.

The phase-separator 10 consists in essence of an enclosure 11, broadly in the shape of a cylinder whose central longitudinal axis is substantially vertical, the walls of which cylinder are heat-insulated and into which passes a duct 12. The duct 12 is connected, via an electrical valve 13, to the storage holder 1. The enclosure 11, which forms an expansion chamber for the fluid, has, in its upper part, a compartment 14 which is filled with a divided-up material 15 such as steel or copper wool. The compartment is also provided with a vent 16 by which the gaseous phase can escape to the open air. In its lower part the enclosure is provided with a discharge pipe 17 which opens from its bottom wall and through which the liquid phase 18 flows by gravity.

The container 20 is formed by a tank having heat-insulated walls 21 which has, at its upper part, an opening 22 which is closed by a cover 23. Cover 23 has pipe 17 passing through it and is provided with a vent 24 to atmosphere. Orifices 26 pass through the bottom wall of tank 21 and allow the liquid phase 27 to flow out by gravity.

At their ends, vents 16 and 24 are provided with protective means 19 and 25 respectively, which may be formed either by non-return valves which prevent the ingress of atmospheric air, or by a small cavity filled with a dessicant substance which is intended to trap the moisture in any air which may enter the separator or tank from the atmosphere.

The system 30 for controlling the electrical valve 13, which latter provides an all-or-nothing supply of cryogenic fluid to the phase-separator 10, consists of an electrical or electronic circuit 31 of a known type which feeds an electrical current to the said electrical valve as dictated by information supplied to it by means for detecting the level of liquid in tank 21, which detection means may for example be formed by two resistive or vapour-tension probes 32*a* and 32*b* which are attached to cover 23 and are located inside the tank at two different heights.

The withdrawal means 40 (of which there are two in the case shown) are situated below tank 21 and communicate directly with orifices 26. Each consists of a cut-off valve 43 which can be operated by hand and a metering valve 42 whose cock-casing i.e., the outer shell of the valve can be interchanged: this enables the size of the passage through it, and thus the liquid throughput, to be altered.

The distributor means 50 are formed by a plurality of flexible heat-insulated tubes 51 which nowhere reach a point lower than their ends, each of which is connected at one end to one of the withdrawal means. The tubes are each provided at their free ends with a liquid dispensing member suitable for its appointed function. In the case shown, one of the dispensing members is formed by a pouring spout or nozzle 52 specially adapted for filling containers of small dimensions, the other being formed by a toroidal ring 53 provided with orifices 54 that are concentric, i.e., directed towards a common centre, to spray the liquid radially onto a jet of molten metal for example.

The way in which the arrangement operates is as follows: Assuming electrical valve 13 to be open, the cryogenic fluid flows out, in the form of a two-phase mixture (gas and liquid), through infeed duct 12 and enters enclosure 11, where the two phases are separated, the gaseous phase escaping through opening 16 and the cold liquid phase 18 collecting in the bottom of the said enclosure and emptying through pipe 17 into tank 21. The level of liquid in the tank settles at a height which constitutes a mean pressure head H measured from the level at which the calibration valves 42 are situated. Head H is determined by the position of probes 32*a* and 32*b*, the electrical valve closing when the said level is reached. When one of the cut-off valves 43 is opened, the liquid flows out under gravity through tube 51 and the dispensing member associated with it, with the result that it pours out in the form of a turbulence-free jet. When the level of the liquid has dropped sufficiently to expose the lower probe, electrical circuit 31 re-opens electrical valve 13 and the phase-separator and then tank 21 are thus supplied with fluid and liquid phase respectively. Electrical valve 13 remains open until the level in tank 21 reaches the higher probe. In this way the liquid in tank 21 maintains the pressure head, in a completely automatic fashion, at a virtually constant value H. The variations ΔH in head H are determined by the vertical distance between the two probes.

It can be seen that the liquid will flow continuously to the point at which it is used whereas tank 21 is replenished intermittantly.

The throughput of the fluid which is fed to the point at which it is used is a function of two parameters: the pressure head H and the size of the effective flow-section of the passage in the regulating valve concerned. If:

$g$ is acceleration due to gravity $s$ is the effective flow-section of the passage in the calibrating valve, and $k$ is a co-efficient applicable to the said passage the throughput (T) in question is given by the formula:

$$T = ks\sqrt{2gH}$$

Due to the smooth flow of cryogenic fluid which it provides and the precise metering which it makes possible, apparatus according to the invention greatly facilitates operations such as the inertizing of crucible furnaces or casting moulds, the protection of jets of molten metal, the filling of certain containers or mechanisms such as hydraulic shock-absorbers, the inhibition by cold of reactions by thermosetting substances, etc.

The apparatus is in no way limited to the embodiment described and shown and numerous modifications could be made to it without departing from the scope of the invention as defined by the appended claims. Thus, as an example, the phase-separator may be formed by a substantially cylindrical enclosure which makes a certain angle with the vertical; such a separator could be built into tank 20. Furthermore, the flexible tubes for the distributor means may be replaced by rigid tubes, and the electrical valve be replaced by a pneumatic valve, whose control system would similarly be pneumatic.

I claim:

1. Apparatus for delivering the liquid phase of a cryogenic fluid to a point open to free air at which it is to be used, said apparatus comprising in combination:

a. a tank in which said cryogenic fluid is stored under pressure;

b. a phase-separator having an infeed duct connected to said tank to allow said fluid, which is delivered in the form of a two-phase mixture, to pass to said separator, and discharge means to allow the liquid phase of said mixture to flow out by gravity, said infeed duct being provided with a member for regulating throughput which can be remotely actuated;

c. a liquid-collecting container which is fed by said discharge means and having outlet means to allow the body of liquid collected in said container to flow out by gravity;

d. a system to control said throughput regulating member which is sensitive to the level of liquid in said container and which is provided to maintain said level constant;

e. adjustable-throughput withdrawal means which are connected to said outlet means from said containers; and f. distributor means connected to said withdrawal means which deliver the said liquid to said point at which it is to be used.

2. Apparatus according to claim 1, wherein said phase-separator consists of a heat-insulated enclosure forming an expansion chamber, into which said infeed duct opens, and which is provided, in its upper part, with a vent communicating with atmosphere to take away the gaseous phase, said discharge means being constituted by a pipe which opens from the lower part of said enclosure.

3. Apparatus according to claim 2, wherein said vent of said phase-separator is provided with protective means formed by a non-return valve.

4. Apparatus according to claim 2, wherein said throughput-regulating member is constituted by an electrical valve.

5. Apparatus according to claim 4, wherein said control system consists of an electrical supply circuit for said electrical valve, said circuit being provided with means for detecting the level of liquid in said tank.

6. Apparatus according to claim 5, wherein said detection means are formed by liquid level probes which are situated in said tank at two different heights.

7. Apparatus according to claim 6, wherein said liquid level probes are resistive probes.

8. Apparatus according to claim 6, wherein said liquid level probes are vapor tension probes.

9. Apparatus according to claim 1, wherein said container is constituted by a tank which has heat-insulated walls and is provided, in its upper part, with a vent communicating with atmosphere, said outlet means being constituted by at least one orifice provided in the bottom wall of said tank.

10. Apparatus according to claim 9, in which said vent of said tank is provided with protective means formed by a non-return valve.

11. Apparatus according to claim 1, wherein said withdrawal means comprise a cut-off valve and a metering valve.

12. Apparatus according to claim 11, wherein said distributor means consist of a heat-insulated tube which is connected at one end to said withdrawal means and which is provided at its free end with a liquid dispensing member.

13. Apparatus according to claim 12, wherein said liquid dispensing member is constituted by a pouring nozzle.

14. Apparatus according to claim 12, wherein said liquid dispensing member is formed by a toroidal ring which is provided with a series of orifices arranged around a common centre point to spray said liquid radially.

* * * * *